United States Patent [19]

Ewbank

[11] Patent Number: 4,771,738

[45] Date of Patent: Sep. 20, 1988

[54] DUAL SLEEVE BOILER MOUNTING APPARATUS

[75] Inventor: Michael E. Ewbank, Rockford, Ill.

[73] Assignee: Sundstrand Corporation, Rockford, Ill.

[21] Appl. No.: 105,932

[22] Filed: Oct. 7, 1987

[51] Int. Cl.[4] ..... F22B 1/02

[52] U.S. Cl. ..... 122/32; 122/21; 122/247; 165/168

[58] Field of Search ..... 122/32, 247, 248, 249, 122/250 R, 166 R, 166 A, 169, 183, 21, 23, 510; 165/163, 168, 144, 145

[56] References Cited

U.S. PATENT DOCUMENTS

| | | | |
|---|---|---|---|
| 2,160,644 | 5/1939 | Clarkson | 122/250 R |
| 2,183,893 | 12/1939 | Price | 122/250 R |
| 2,642,849 | 6/1953 | Donohue | 122/32 |
| 2,664,275 | 12/1953 | Carter | 122/32 |

*Primary Examiner*—Steven E. Warner
*Attorney, Agent, or Firm*—William D. Lanyi

[57] ABSTRACT

A dual sleeve boiler is arranged to dispose a portion (72, 74, 76) of its fluid conduit between a support member (64) of the boiler and the heat generating portion (20, 24) of the boiler. The end of a conduit through which water is introduced to the boiler is disposed between an enclosing means (24) which forms an axial end of the boiler and a cylindrical tube (64) disposed through the center of the boiler for purposes of supporting the boiler. As relatively cool fluid is introduced into the conduit of the boiler, it passes between the heat generating portions (20) of the boiler and the support tube (64) and provides a thermal barrier to prevent heat from traveling, through conduction, into the supporting means (64) which is attached to an external support member (71). This prevents heat from flowing into the external support member (71) and possibly damaging heat sensitive components attached thereto.

9 Claims, 3 Drawing Sheets

FIGURE I

DUAL SLEEVE BOILER MOUNTING APPARATUS

BACKGROUND OF THE INVENTION

1. Field of the Invention

The present invention relates generally to a mounting arrangement for a dual sleeve boiler and, more particularly, to a mounting arrangement which provides a thermal barrier between a heat producing portion of the boiler and the mounting portion of the boiler.

2. Description of the Related Art

Many different types of boilers and heat exchangers are known to those skilled in the art. Typically, a source of heat is provided for the purpose of raising the temperature of a fluid that is passing through a heat exchanging portion of the boiler. This source of heat can be in the form of combustion, wherein a fuel is burned, or, alternatively, in the form of a chemical reaction resulting from the mixing of various chemicals for the purpose of raising the temperature in a combustion chamber of the boiler. In other types of heat exchangers, the device can employ two or more fluid flow paths which are separated from each other, but which pass in close proximity with each other within the heat exchanger for the purpose of transferring heat from one fluid to another. In this type of heat exchanger, the primary source of heat is external to the heat exchanger and a first fluid is heated by the primary source of heat. This first fluid is then circulated through one or more conduits within the heat exchanger in close proximity with a second fluid passing through different conduits within the structure of the heat exchanger.

U.S. Pat. No. 4,644,906, which issued to Garabedian et al on Feb. 24, 1987, discloses a double tube helical coil steam generator in which a multiplicity of inner tubes are provided to conduct water. These inner tubes are individually surrounded by outer tubes containing liquid metal as a heat transfer agent. In this device immersion of the double tube helical coil in the hot liquid metal causes efficient transfer of heat across the liquid metal in the outer tube to the water in the inner tube for the purpose of creating superheated steam.

U.S. Pat. No. 4,446,820, which issued to Jansing et al on May 8, 1984, discloses a steam generator which is heated by liquid metal. Typically used in nuclear power plants, this steam generator comprises several coiled tube bundles which are arranged in series and disposed in a common container in which steam is generated and superheated.

U.S. Pat. No. 4,433,722, which issued to Fueglister on Feb. 28, 1984, discloses a heat exchanger which has pipe coils that are supported in support plates. This patent describes a thin walled resilient sleeve which is disposed between each group of support plates and a pipe at the center of the pipe coils. The sleeves of this heat exchanger enable the support plates, which become hotter than the pipe coils during operation, to expand toward the central pipe for the purpose of reducing the heat expansion of the pipe coils and the resulting bending stresses.

U.S. Pat. No. 4,307,685, which issued to Robin et al on Dec. 29, 1981, discloses a heat exchanger for use with a sodium heated steam generator. This device comprises a vertical outer cylindrical shell, a distributor for supplying the inner space of the shell with liquid sodium and at least one tube bundle disposed within the shell for circulating water in heat exchange relation with the sodium. It also comprises a means for maintaining an inner gas atmosphere above a predetermined free level of liquid sodium. The top and bottom tube ends are fitted with thermal sleeves for joining them to the lateral wall of the shell and passing them through this shell.

U.S. Pat. No. 4,137,967, which issued to Hirschle on Feb. 6, 1979, discloses a steam generator with expansion pipe loops which connect the tubes of the heat exchanger to the discharge lines. The pipe loops are suspended by double armed levers which are movably secured at the ends of the mounting system and anchoring system of the steam generator. The portions of the pipe loops which are connected to the fulcrum of the respective levers, as well as the fulcrums themselves, are chosen to render the stresses in the pipe loops as low as possible and approximately equal on both sides of pivots.

U.S. Pat. No. 4,552,211, which issued to Weber on Nov. 12, 1985, discloses a heat exchanger with convection suppressing longitudinal baffles. This patent describes a heat exchanger which has a vertical central tube and a concentric jacket between which the support plates extend radially and axially. The support plates carry a plurality of heat exchanger tubes and the jacket is formed near the top and bottom ends with apertures for a heat yielding medium which flows around the heat exchanger tubes.

U.S. Pat. No. 4,624,304, which issued to Hayes on Nov. 25, 1986, discloses an expandable support for insertion into a tube bundle. Flattened tubes are inserted between each layer of tubes in the tube bend region of a shell and tube type heat exchanger. The flattened tubes are then pressurized to expand them in the region below the tube bend so that they lock the support plates into place for the purpose of preventing them from vibrating and causing damage to the tubes in the first rows of the tube bundle.

U.S. Pat. No. 3,921,708, which issued to Brenner on Nov. 25, 1975, describes a heat exchanger in which an element under internal pressure is a thin walled flexible tube whose inner and outer surfaces have the form of corrugations with supporting means. These act to limit the expansion of the flexible tube to prevent deflection from the longitudinal axis.

U.S. Pat. No. 3,720,259, which issued to Fritz et al on Mar. 13, 1973, discloses a tubular heat exchanger supporting and spacer structure. Spirally wound tubes are arranged next to each other surrounding a given axis with convolutions of one tube axially aligned with the convolutions of the adjacent tube. These tubes form a group having an inner region directed toward the latter axis and an outer region directed away from the latter axis. This spacer structure serves to transmit to the supporting structure the weight of the tubes and the spacer structure as well as any thermal or mechanical stresses or reaction forces resulting from flow of the fluids during operation of the heat exchanger.

U.S. Pat. No. 3,964,416, which issued to Kiraly et al on June 22, 1976, discloses a boiler reactor which comprises a cylindrical casing with closures at its opposite ends. Also, a steam generating tube is provided and disposed adjacent the inner surface of the casing.

U.S. Pat. No. 3,100,523, which issued to Marrujo on Aug. 13, 1963, discloses a heat exchanger with a helical coil. This heat exchanger comprises a base which has an integrally formed upstanding tubular wall around its outer periphery. The cylindrical wall has an external tapered surface about which is disposed a helically wound conduit or heat exchanger coil.

U.S. Pat. No. 1,224,105, which issued to Davison on Apr. 24, 1917, discloses a water tube boiler for use with submarines. This boiler provides an inner hull adapted to contain fore and aft of the boiler compartment various subdivisions of the interior of the inner hull to establish battery compartments, cruise quarters, engine room, etc. The fire box of the boiler is double ended so that gases from the burners may be caused to circulate among the tubes by means of suitably arranged baffles before entering an uptake portion.

Dual sleeve boilers are generally known to those skilled in the art. In certain types of these boilers, tubes are helically wound around a centerline to define a cylinder. The tubes can be would tightly with each of the turns of the helix being in contact with adjacent turns to permit the turns to be attached together by some appropriate means, such as welding, for the purpose of forming a generally impermiable cylinder with the walls of the cylinder comprising the tubes themselves. If two of these cylinder structures are disposed in coaxial and concentric relation with each other, a generally annular space can be formed therebetween in which a heat generating reaction can be contained. With the addition of end caps, or some means of enclosing the ends of the annular space, a confined region can be defined within the annular space for the purpose of containing a heat generating reaction which can be a form of combustion or a heat generating chemical reaction. A fluid can be directed through the tubes of both the inner and outer cylindrical structures for the purpose of absorbing heat from the reaction occurring within the annular space.

SUMMARY OF THE INVENTION

In some applications, a boiler must be supported in such a way which requires the use of non-rigid support members. These support members may require the use of materials which are sensitive to extreme temperatures and subject to damage if they are exposed to excessive heat. For example, elastomeric components may be used for the purpose of providing a resilient support structure for the boiler or for the purpose of reducing the amount of sound that is transmitted from the boiler to other structures. It should be apparent that extreme temperatures could cause severe damage to these types of nonmetallic support structures. Therefore, for various reasons it is sometimes desirable to provide a boiler mounting apparatus which serves to provide a thermal barrier between the heat producing, or hottest, portion of the boiler and the support structure used in association with the boiler. The present invention is specifically directed to this type of mounting apparatus for a boiler.

The present invention provides a first cylindrical structure which is formed from a predetermined length of a first tube which is disposed in a helical arrangement around a centerline. A second cylindrical structure is provided which is similar to the first cylindrical structure in arrangement. Both the first and second cylindrical structures are formed by winding a tube around a centerline in a helical manner with each turn of the tube being disposed proximate its adjacent turns and with each turn being attached to its adjacent turns for the purpose of forming cylindrical structures which have walls that are generally impermeable. In a preferred embodiment of the present invention, the first and second cylindrical structures are arranged in coaxial and concentric relation with each other so as to form a generally annular space between the cylindrical structures. A first enclosing means is provided at a first end of this annular space and is connected to first ends of both the first and second cylindrical structures. A second enclosing means is provided at the second ends of both the first and second cylindrical structures for the purpose of enclosing the opposite end of the annular space. A means is provided for supporting the cylindrical structures. This supporting means is connected to a first portion of the first cylindrical structure proximate its first end. For the purpose of providing a thermal barrier between the heat producing region of the boiler, within the annular space, and the supporting means, the first end of the first cylindrical structure is disposed between the supporting means and the first enclosing means. In a preferred embodiment of the present invention, the first tube from which the first cylindrical structure is formed and the second tube from which the second cylindrical structure is formed are connected in fluid communication with each other so that a fluid can be introduced at the first end of the first cylindrical structure and pass through the first tube along its entire length before passing into the second tube of the second cylindrical structure and through the entire length of the second tube prior to flowing out of an exhaust port. As the fluid passes through both the first and second cylindrical structures of the present invention, it is heated because of the proximity of both the first and second tubes to the heat generating portion of the boiler within the annular space. Therefore, it should be understood that the fluid entering the first end of the first cylindrical structure is significantly lower in temperature than the fluid exiting from the exhaust port of the second cylindrical structure. Therefore, the first end of the first cylindrical structure can be used as a thermal barrier disposed between the portions of the boiler which are at the highest temperature and the support tube which is intended to be connected to a support structure that could possibly be damaged if it is exposed to extremely high temperatures. This thermal barrier, provided by the first end of the first cylindrical structure, prevents heat from passing directly from the hottest portions of the boiler structure to the heat sensitive portions of the support structure.

BRIEF DESCRIPTION OF THE DRAWING

The present invention will be more clearly understood from a reading of the description of the preferred embodiment in conjunction with the drawing, in which.

DESCRIPTION OF THE PREFERRED EMBODIMENT

Figure 1:
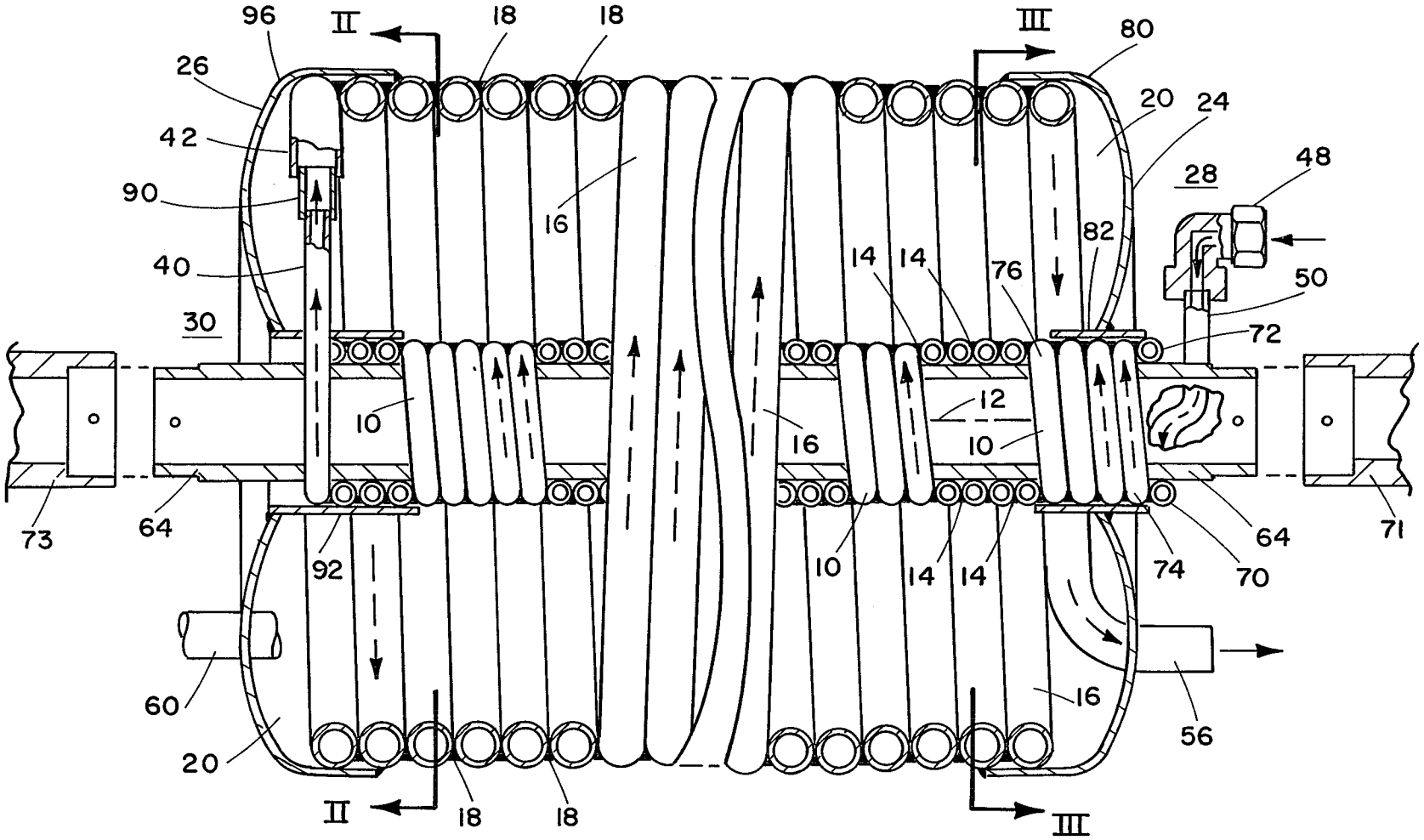
FIG. 1 illustrates a dual sleeve boiler incorporating a support structure made in accordance with the present invention.

In FIG. 1, a dual sleeve boiler is shown. A first cylindrical structure 10 comprises a first predetermined length of a first tube helically wound around a centerline 12. Each turn of the first tube is disposed proximate its adjacent turns and each turn is connected to its adjacent turn by some suitable means, such as weld 14. The first cylindrical structure 10 therefore provides a generally impermeable cylindrical wall. A second cylindrical structure 16 comprises a predetermined length of a second tube wound in a manner similar to that described above in conjunction with the first cylindrical structure. Each turn of the second tube is disposed proximate its adjacent turns and the turns are connected together by some suitable means, such as welds 18. When constructed in this manner, the second cylindrical structure also provides a generally impermeable cylindrical wall. The first 10 and second 16 cylindrical structures are arranged in concentric and coaxial relation with each other, as shown in FIG. 1, to define an annular space 20 therebetween.

A first enclosing means 24 is provided for enclosing a first end of the annular space 20. As can be seen in FIG. 1, the first enclosing means 24 is an end cap structure which is attached to both the first cylindrical structure 10 and the second cylindrical structure 16. A second enclosing means 26 is also attached to both the first cylindrical structure 10 and the second cylindrical structure 16 for the purpose of enclosing a second end 30 of the annular space 20. It should be understood that the first end of the dual sleeve boiler is designated by reference numeral 28 and the second end of the dual sleeve boiler is designated by reference numeral 30 for purposes of this description. Throughout the description of the preferred embodiment, the ends of the components shown in FIG. 1 which are located at the right side of the figure will be referred to as the first end of its component and the ends of the components shown in FIG. 1 which are located at the left side of the drawing will be referred to herein as the second end of its associated component.

The annular space 20 is defined at its radially inward portion by the first cylindrical structure 10 and at its radially outward portion by the second cylindrical structure 16. Furthermore, the annular space 20 is defined at its first axial end 28 by the first enclosing means 24 and at its second end 30 by the second enclosing means 26. It should therefore be apparent that the annular space 20 is confined by the first cylindrical structure 10, the second cylindrical structure 16, the first enclosing means 24 and the second enclosing means 26. It is within the annular space 20 that a heat producing reaction is provided for the purpose of generating heat which raises the temperature of a fluid passing through both the first and second tubes.

At the second end 30 of the first cylindrical structure 10, the first tube is connected, at its end 40, to an end 42 of the second tube of the second cylindrical structure 16. This connection provides a fluid communication between the first tube of the first cylindrical structure 10 and the second tube of the second cylindrical structure 16. It should be understood that many alternative means of connecting the first and second tubes can be employed within the scope of the present invention. In the particular embodiment illustrated in FIG. 1, the first tube of the first cylindrical structure 10 is smaller in diameter than the second tube of the second cylindrical structure 16 and, therefore, it is appropriate to use an intermediate tube 90 which has an outside diameter generally equivalent to the inside diameter of the second tube and also has a inside diameter which is generally equivalent to the outside diameter of the first tube. In this type of situation, the use of an intermediate tube such as tube 90 is appropriate. However, in alternative embodiments of the present invention, it may be preferable to utilize a different type of transition piece to connect the first and second cylindrical structures in fluid communication with each other.

In FIG. 1, a connector 48 is shown attached to a first end 50 of the first tube. This connector 48 is used to introduce a fluid into the first end 50 of the first tube. A fluid which is introduced into the connector 48 flows, in the direction indicated by the arrows, through the first tube along a helical path from the first end 28 of the dual sleeve boiler toward the second end 30 of the dual sleeve boiler. As the fluid passes through the end 40 of the first tube, it enters the end 42 of the second tube and proceeds to pass through the second tube, along a helical path, in a direction from the second end 30 of the boiler toward the first end 28 of the boiler. Eventually, the fluid passes through the exhaust port 56 and exits from the boiler. Throughout the figures, arrows are used to indicate the direction of flow of the fluid passing through the tubes of both the first cylindrical structure 10 and the second cylindrical structure 16.

Within the annular space 20, some type of heat generating reaction is caused to occur for the purpose of providing heat which raises the temperature of the fluid passing through the first and second cylindrical structures. The heat producing reaction can be of various types. One type of heat producing reaction would be the combustion of a fuel within the annular space 20. Alternative means of heat producing reactions could include chemical reactions resulting from the introduction of chemicals into the annular space 20 which, when combined, provide a source of heat. It should be understood that the present invention is not limited to one particular type of heat producing reaction. For this reason, specific heat producing methods will not be discussed in detail herein. However, it should be understood that a chemical reaction within the annular space 20 is a possible means for producing the heat as a result of the combination of chemicals. Therefore, an inlet port 60 is shown at the second end 30 of the boiler for the purpose of representing an exemplary means for introducing a chemical into the annular space 20. It should be apparent that the location of the inlet port 60 may or may not be critical to the operation of a boiler incorporating the present invention and, furthermore, that multiple ports could alternatively be used.

For the purpose of supporting the boiler shown in FIG. 1 and attaching the boiler to some external component 71, a support means 64 is provided. In FIG. 1, the support means 64 is shown to be a generally cylindrical tube extending axially through the first cylindrical structure 10. A tube of the type shown in FIG. 1 is used in a preferred embodiment of the present invention. However, it should be understood that alternative types of support structures could also be employed within the scope of the present invention. The support structure 64 extends outward from both axial ends of the first cylindrical structure 17 and is shaped to be received by external support members 71 and 73. As shown in FIG. 1, the first end of the supporting means 64 is shaped to be received by the external support member 71 and the second end of the supporting means 64 is shaped to be received by the external support member 73. When the supporting means 64 is attached to the external support members, 71 and 73, it provides a means for supporting the dual sleeve boiler arrangement which comprises the first cylindrical structure 10, the second cylindrical structure 16 and both the first and second enclosing means, 24 and 26, respectively.

The primary purpose of the present invention is to protect components of the external support member 71 which may otherwise be damaged if exposed to high temperatures. For purposes of describing this specific characteristic of the present invention, a typical exemplary illustration will be discussed herein. In a preferred embodiment of the present invention, a fluid is introduced into the connector 48. As the fluid, such as water, is introduced into the connector 48, it hypothetically has a temperature of approximately 150 degrees fahrenheit. As the fluid passes from the first end of the first tube toward the second end of the first tube, its temperature is raised to approximately 600 degrees fahrenheit because of the proximity of the first cylindrical structure 10 to the heat producing reaction within the annular space 20. If the fluid within the tube is water, it will typically be a mixture of steam and water as it exits from the end 40 of the first tube and enters the end 42 of the second tube at the second end 30 of the boiler. As this fluid continues to flow through the second tube, its temperature is progressively raised because of the proximity of the second cylindrical structure 16 to the annular space 20 within which the heat producing reaction is occurring. As the fluid exits from the second cylindrical structure 16, at the exhaust port 56, it is superheated steam at a temperature of approximately 1600 degrees fahrenheit. It should also be apparent that the first enclosing means 24 and second enclosing means 26 will be expected to be at a temperature significantly in excess of 1600 degrees fahrenheit because of the proximity of the first and second enclosing means to the annular space 20 within which the heat producing reaction is actually occurring.

If no precautionary steps are taken, this excessive heat will travel through the first enclosing means 24, by the process of conduction, toward the external support member 71 and cause damage to any heat sensitive components which are connected to the external support member 71. These heat sensitive components, which can be either an elastomeric compound or any other material which can be potentially damaged by excessive heat, will most likely be damaged because of the conduction of heat from the structure of the boiler through the supporting means 64 and the external support member 71.

The present invention inhibits the flow of heat from the first enclosing means 24 toward the external support member 71 by disposing a first end of the first cylindrical structure 10 between the first enclosing means 24 and the first end of the supporting means 64. As described above, the first portion of the first cylindrical structure 10 carries the fluid which is introduced into the connector 48 and which is at the lowest temperature that the fluid experiences as it travels through the first and second tubes. Therefore, this fluid traveling through the first end portion of the first cylindrical structure 10 provides a thermal barrier between the first enclosing means 24 and the first end of the supporting means 64. The flow of this fluid through the first tube from the first end 28 of the boiler toward the second end 30 of the boiler carries the heat in a direction from right to left in FIG. 1. This flow of fluid through the first cylindrical structure 10 carries the heat away from the external support member 71 and therefore prevents damage from occurring to the heat sensitive components connected to the external support member 71.

Although the supporting means 64 is illustrated in FIG. 1 and described above as a cylindrical tube extending completely through the boiler, it should be understood that alternative embodiments of the present invention could utilize a much shorter cylinder that extends from the first end 28 of the boiler, as shown in FIG. 1, partially into the first cylindrical structure 10. This type of construction would provide support at only one end of the boiler. If this alternative type of support apparatus was used to support the boiler shown in FIG. 1, the supporting means 64 would extend axially away from the boiler as shown in FIG. 1, but with a much shorter segment extending axially toward the left, away from the first end 28 of the boiler. The supporting means 64 would only extend into the first cylindrical structure 10 for a short distance. Therefore, by connecting the supporting means 64 to the external support member 71, the boiler would be supported, in a cantilever manner, from only one end and the external support member 73, shown at the left side of FIG. 1, would not be used. However, it should be understood that, even in this type of alternative configuration, the operation of the present invention would be the same as described herein with a first portion of the first cylindrical structure 10 being disposed between the supporting means 64 and the first enclosing mean 24.

The specific characteristic of the present invention which prevents heat damage from occurring to components connected to the external support member 71 is related to the fact that the first end of the first tube is disposed between the first enclosing means 24 and the supporting means 64. In operation, a fluid is introduced into the connector 48 and this fluid then passes into the first end 50 of the first tube. The fluid continues to travel through the first tube, as shown by the dashed line arrow in the S-shaped bend, or jog portion, of the first tube which is visible through the supporting means 64 in FIG. 1 which has been partially removed for the purpose of illustration, and eventually passes to location 70 of the first tube. In the section view of the first cylindrical structure, it should be understood that the fluid continues to travel, in a helical path, through the first cylindrical structure and passes through location 72 in the section view of FIG. 1, behind the supporting means 64, to location 74 of the first tube. After traveling through several turns of the first tube, the fluid eventually reaches location 76 of the first tube. It should be understood that the first few turns of the first cylindrical structure are disposed directly between the first enclosing means 24, or end cap, of the boiler, and the supporting means 64. In FIG. 1, these first few turns are shown between locations 72 and 76 and are illustrated as the first five turns of the first cylindrical structure 10. It should be clearly understood that the specific number of turns of this first portion of the first cylindrical structure 10 can vary within the scope of the present invention. As discussed above, the fluid entering the connector 48 is approximately 150 degrees fahrenheit and, in a preferred embodiment of the present invention, is water. This low temperature water provides cooling in the region of the first few turns of the first cylindrical structure 10 between locations 72 and 76 of the first tube. As it passes between the first enclosing means 24 and the supporting means 64, it prevents the heat being generated within the annular space 20 from passing, through the means of conduction, from the first enclosing means 24 to the supporting means 64.

In the embodiment of the present invention illustrated in FIG. 1, the first enclosing means comprises an end cap portion 80 which is attached to a generally cylindrical member 82 for the purpose of constructing the first enclosing member 24 in such a way so as to facilitate its use in cooperation with the present invention. The generally cylindrical tube 82 provides the radially outer contact between the first enclosing means 24 and the first cylindrical structure 10. This facilitates the heat transfer from the first enclosing means 24 to a plurality of turns of the first portion of the first cylindrical structure 10.

Figure 2:
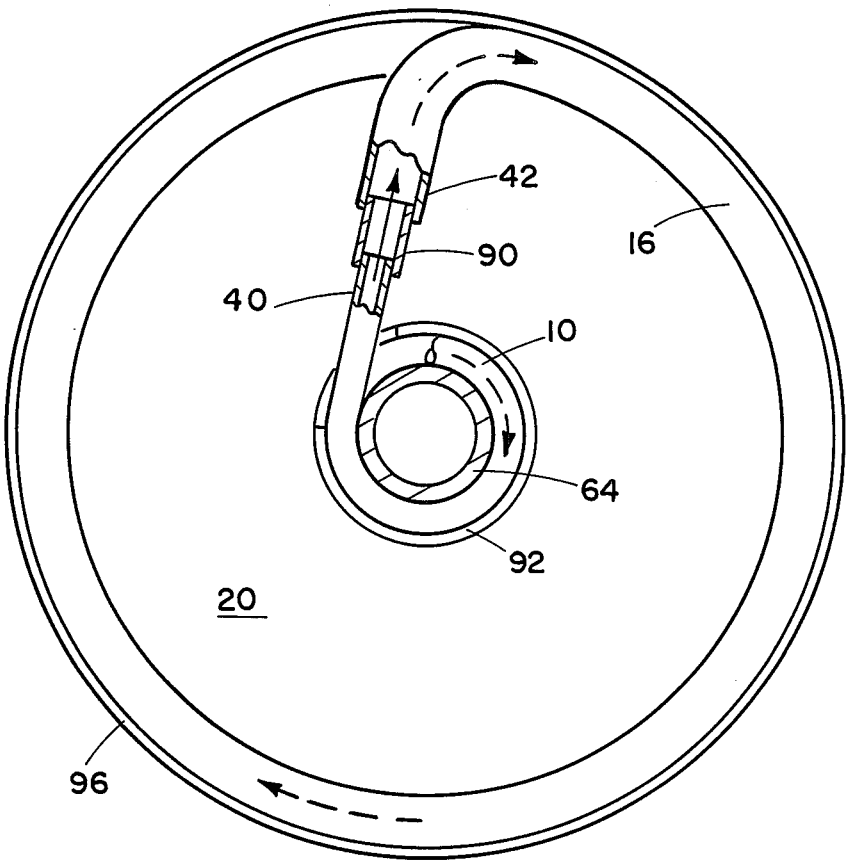
FIG. 2 represents a section view of the boiler illustrated in FIG. 1.

FIG. 2 shows a section view of FIG. 1. It shows the supporting means 64 with the first tube of the first cylindrical structure 10 being disposed around the supporting means 64. The end 40 of the first tube is shown extending away from the first cylindrical structure and being connected to an end 42 of the second tube by an intermediate piece 90 which is attached to both the first and second tubes for the purpose of providing fluid communication between the first cylindrical member 10 and the second cylindrical member 16. A generally cylindrical tube 92 is shown in FIG. 2 and in FIG. 1. It is similar to the cylindrical tube 82 described above in conjunction with the first enclosing means 24, but with an opening through which the first tube can extend so that the end 40 of the first tube can be connected to the end 42 of the second tube as described above. The cylindrical tube 92 is attached to an end cap 96 portion of the second enclosing means 26 for the purpose of forming the entire configuration in such a way so as to facilitate assembly between the first cylindrical structure 10 and the second cylindrical structure 16. In FIG. 2, the radially outer portion of the end cap 96 is shown disposed around the second cylindrical structure at the second end 30 of the boiler.

Figure 3:
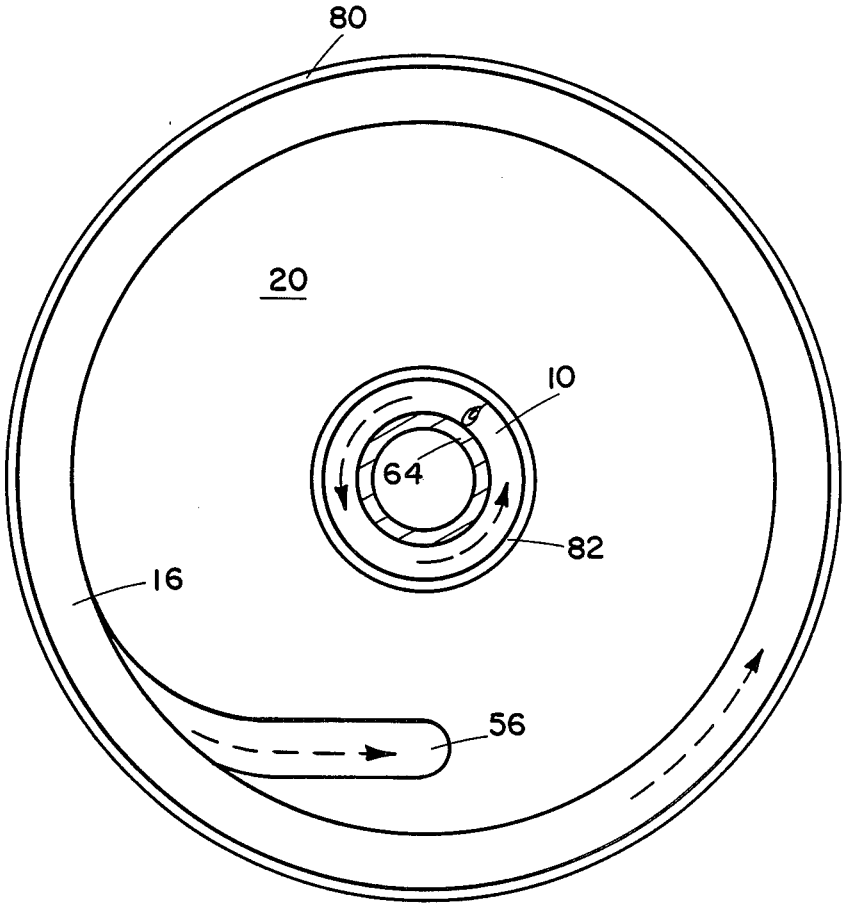
FIG. 3 illustrates a section view of the boiler illustrated in FIG. 1.

FIG. 3 shows an end view of the boiler of FIG. 1 in a direction opposite to that of FIG. 2. In FIG. 3, the supporting means 64 is shown with the first cylindrical structure 10 being disposed radially outward from it. The cylindrical member 82 of the first enclosing means 24 is shown disposed radially outward from the first cylindrical structure. The second cylindrical structure 16 is shown disposed in association with the radially outer portion of the end cap 80. As is apparent from FIG. 3, the first cylindrical structure 10 and the second cylindrical structure 16 are disposed in coaxial and concentric relation with each other to form an annular space 20 between them. At the first end of the boiler, the second tube which is used to construct the second cylindrical structure 16, is diverted from its helical path toward the exhaust port 56 which permits the second tube to extend through the end cap 80 of the first enclosing means 24.

It should be understood that in a typical application of the subject invention, the temperature of the exhaust port 56 will be expected to be approximately 1600 degrees fahrenheit because of its use at the end of the fluid path of the boiler where superheated steam is conducted away from the boiler and its connection to the end cap 80 of the first enclosing means 24. Also during operation, the temperature of the end cap 80 and the cylindrical member 82 of the first enclosing means will reach temperatures which are significantly higher than that which is acceptable for use with heat sensitive components such as those described above. The present invention takes advantage of the fact that the fluid entering the connector 48 is typically about 150 degrees fahrenheit as it enters the end 50 of the first tube to begin its path toward the second end 30 of the first tube. As described above, the present invention utilizes this relatively low temperature to provide a thermal barrier between the cylindrical tube 82, which is a part of the first enclosing means, and the supporting means 64. This thermal barrier, which is shown in FIG. 1 as comprising approximately the first five turns of the first cylindrical structure 10, prevents heat from being conducted directly from the first enclosing means 24 to the supporting means 64 and, subsequently, to the external support member 70.

Although the present invention has been described in significant detail and with specific examples of its preferred embodiment, it should be understood that alternative constructions could be implemented within the scope of the present invention to provide a thermal barrier between the support member of a boiler and the heat producing portions of the boiler by using a portion of the fluid conduit which carries feed water through the boiler.

What I claim is:

1. A boiler, comprising:

a first cylindrical structure comprising a first predetermined length of a first tube disposed in a helical arrangement around a centerline of said first cylindrical structure, said first cylindrical structure having a first diameter;

a second cylindrical structure comprising a second predetermined length of a second tube disposed in a helical arrangement around a centerline of said second cylindrical structure, said second cylindrical structure having a second diameter, said second tube being connected in fluid communication with said first tube, said second diameter being larger than said first diameter, said first and second cylindrical structures being disposed in coaxial association with each other to form an annular space therebetween;

first means for enclosing a first end of said annular space, said first enclosing means being connected to a first end of both of said first and second cylindrical structures;

second means for enclosing a second end of said annular space, said second enclosing means being connected to a second end of both of said first and second cylindrical structures; and means for supporting said first cylindrical structure, said supporting means being connected to a first portion of said first cylindrical structure proximate said first end of said first cylindrical structure, said first cylindrical structure being disposed between said supporting means and said first enclosing means.

2. The boiler of claim 1, wherein:

said first tube is smaller in diameter than said second tube.

3. The boiler of claim 1, wherein:

said supporting means comprises a cylinder disposed radially inward from said first portion of said first cylindrical structure.

4. The boiler of claim 1, further comprising:

means for introducing a fluid into a first end of said first tube proximate said first end of said first cylindrical structure.

5. The boiler of claim 4, further comprising:

means for conducting said fluid through said first tube from said first end of said first cylindrical structure toward said second end of said first cylindrical structure and into said second tube at said second end of said second cylindrical structure.

6. A boiler, comprising:

a first cylinder comprising a continuous helically wound first tube, said first tube being arranged to form an impermeable cylindrical wall of said first cylinder;

a second cylinder comprising a continuous helically wound second tube, said second tube being arranged to form an impermeable cylindrical wall of said second cylinder, said first and second cylinders being disposed concentrically and coaxially with each other, said first and second cylinder being arranged to define a generally annular space therebetween;

first means for enclosing a first end of said annular space, said first enclosing means being connected to a first end of said first cylinder and a first end of said second cylinder;

second means for enclosing a second end of said annular space, said second enclosing means being connected to a second end of said first cylinder and a second end of said second cylinder; and means for supporting said first cylinder, said supporting means being connected to said first cylinder with said first cylinder being disposed between said first enclosing means and said supporting means.

7. The boiler of claim 6, wherein:

said supporting means is disposed radially inward from said first cylinder.

8. The boiler of claim 7, further comprising:

means for introducing a fluid into said first tube at said first end of said first cylinder.

9. The boiler of claim 8, wherein:

said first and second tubes are connected in fluid communication with each other proximate said second ends of said first and second cylinders.

* * * * *